US005238042A

United States Patent [19]

Guerrico-Echeverria

[11] Patent Number: 5,238,042

[45] Date of Patent: Aug. 24, 1993

[54] WINDOW BLIND SYSTEM

[76] Inventor: Nicolas Guerrico-Echeverria, Carrera 42 No. 12A-61, Bogota, Colombia

[21] Appl. No.: 773,272

[22] Filed: Oct. 9, 1991

[51] Int. Cl.[5] ..... E06B 3/48

[52] U.S. Cl. ..... 160/104; 49/87.1; 49/77.1; 49/92.1

[58] Field of Search ..... 49/87 HN, 91 WS, 77 DG, 49/90 PH, 92 SS; 160/90, 107, 104

[56] References Cited

U.S. PATENT DOCUMENTS

| | | | |
|---|---|---|---|
| 145,481 | 12/1873 | Beach et al. . | |
| 191,951 | 6/1877 | Fawcett . | |
| 360,058 | 3/1887 | Snell et al. . | |
| 732,809 | 7/1903 | Zborowski . | |
| 1,039,291 | 9/1912 | Jackle . | |
| 1,695,768 | 12/1928 | Kelly . | |
| 2,217,472 | 10/1940 | Cosowsky | 49/87 HN X |
| 2,577,072 | 12/1951 | Cotner | 49/87 HN X |
| 2,601,707 | 1/1952 | Hyland . | |
| 2,954,590 | 10/1960 | Dynner | 49/87 HN X |
| 3,110,936 | 11/1963 | Berard . | |
| 3,188,074 | 6/1965 | Revitz et al. | 49/87 HN |
| 4,160,343 | 7/1979 | Hubbard . | |
| 4,292,763 | 10/1981 | Barnes et al. . | |
| 4,485,589 | 12/1984 | Rodriguez-Torres . | |
| 4,850,138 | 7/1989 | Watanabe et al. | 49/91 WS X |
| 4,889,040 | 12/1989 | •Man | 49/87 HN X |

FOREIGN PATENT DOCUMENTS

| | | |
|---|---|---|
| 127847 | 10/1945 | Australia . |
| 206649 | 2/1940 | Switzerland . |

*Primary Examiner*—David M. Purol

[57] ABSTRACT

A window has a rectangular frame with pivotable sections movable between an opened and closed position. A level connected to a movement transmission bar is provided to pivot the sections about pegs mounted to a support in the frame. The level is of a deformable material and has a detent on a shaft thereof. The detent will engage a first or second opening in the frame to lock the sections in an opened or closed position. The lever can be bent to remove the detent from one of the openings and to slide the detent along the frame to the other opening. When the detent reaches the other opening, the lever will resume its initial configuration and the sections will again be locked in position. The frame has various grooves such that multiple frames can be interlocked together or runners or a wall can be mounted thereto. The sections are aerodynamically formed and are generally hollow except for interior longitudinal walls and a removable reinforcing insert. The windows allow easy ventilation and are of a relatively simple construction.

20 Claims, 10 Drawing Sheets

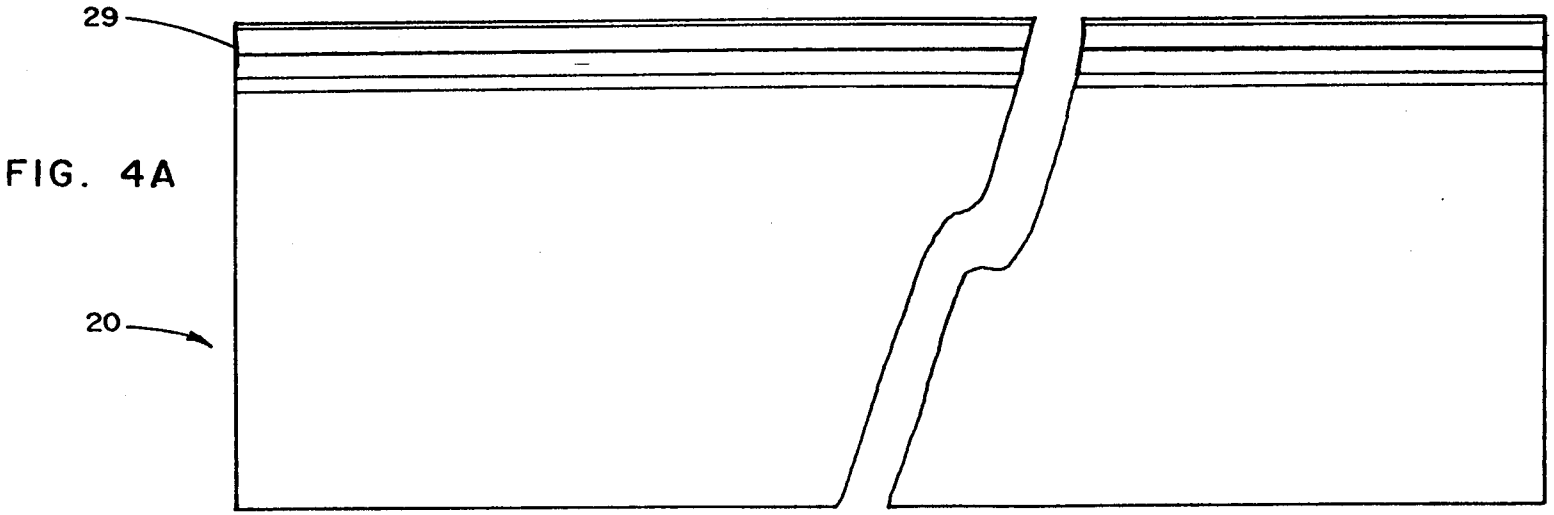
FIG. 4A
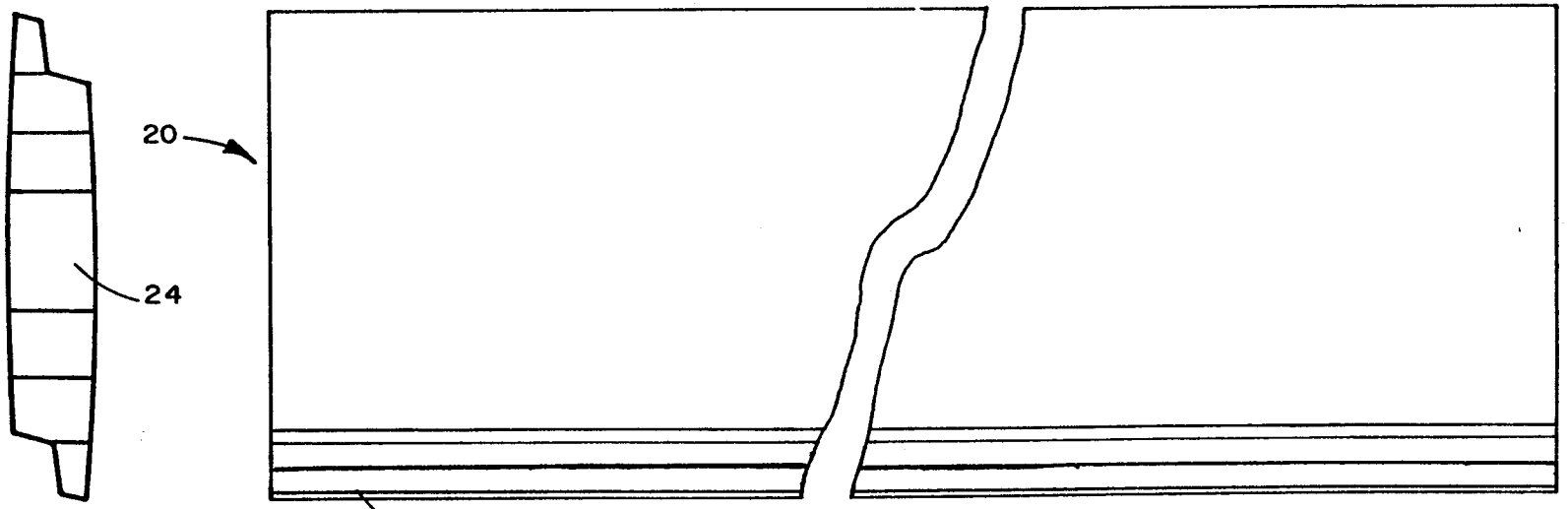
FIG. 4
FIG. 4B

WINDOW BLIND SYSTEM

BACKGROUND OF THE INVENTION

Field of the Invention

The present invention relates to a window fitted with rotating sections in the form of a venetian blind. This window has a generally rectangular frame, a plurality of pivotable sections and means for moving the sections between an opened and closed position.

DESCRIPTION OF THE BACKGROUND ART

Various windows are known of the venetian blind type. However, these windows are relatively complicated to manufacture and are inefficient. For example, U.S. Pat. No. 3,110,939 to Bernard discloses a window with rotating sections. These sections, however, are of an inflexible design which will not permit expansion or contraction of their shape due to climate changes. These sections therefore tend to quickly shatter. Moreover, the system for opening and closing these sections involves a winding handle with several moving parts of a relatively complex design. Accordingly, these elements wear out and are expensive to replace. Further, since it is intended for use as a primary window, it needs additional pieces which make it complicated to assemble and disassemble.

Further, conventional windows are often difficult and expensive to include locking features, screens or runners. Many of these prior art designs are not readily insertable into existing windows and are relatively expensive to manufacture and maintain.

SUMMARY OF THE INVENTION

Accordingly, it is a primary object of the present invention to provide a window which is easy to assemble and disassemble at a low cost.

Another object of the present invention is to provide a window having pivotable sections rotated by a simple and efficient mechanism easily used by an operator.

A further object of the present invention is to provide a window with rotating sections made of any material (such as glass, wood or plastic) that can be easily altered by a user.

Yet another object of the present invention is to provide a window which is flexible in installation so that it can be used as a fixed window, a sliding window or a series of windows without changes being needed for the building structure.

A further object of the present invention is to provide a window which is highly functional and reliable and which can be economically manufactured and installed.

Still another object of the present invention is to provide a window which has few moving parts and is therefore less subject to wear and which is easy and inexpensive to maintain.

Another object of the present invention is to provide a window which allows for expansion and contraction due to changes in climate without damage to the window.

Yet a further object of the present invention is to provide a window which will prevent rain from entering a home and which can quickly and easily be opened or closed.

A further object of the present invention is to provide a window which is lockable in the closed position to provide for security.

An additional object of the present invention is to provide a window in which the slots or sections can easily be changed to permit customization of the window.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 is a top view of a rotating section of the window of the present invention;

FIG. 4A is a bottom view of a rotating section of the window of the present invention;

FIG. 4B is a cross sectional view of the rotating section of the window of the present invention;

DETAILED DESCRIPTION OF THE PREFERRED EMBODIMENTS

Figure 1:
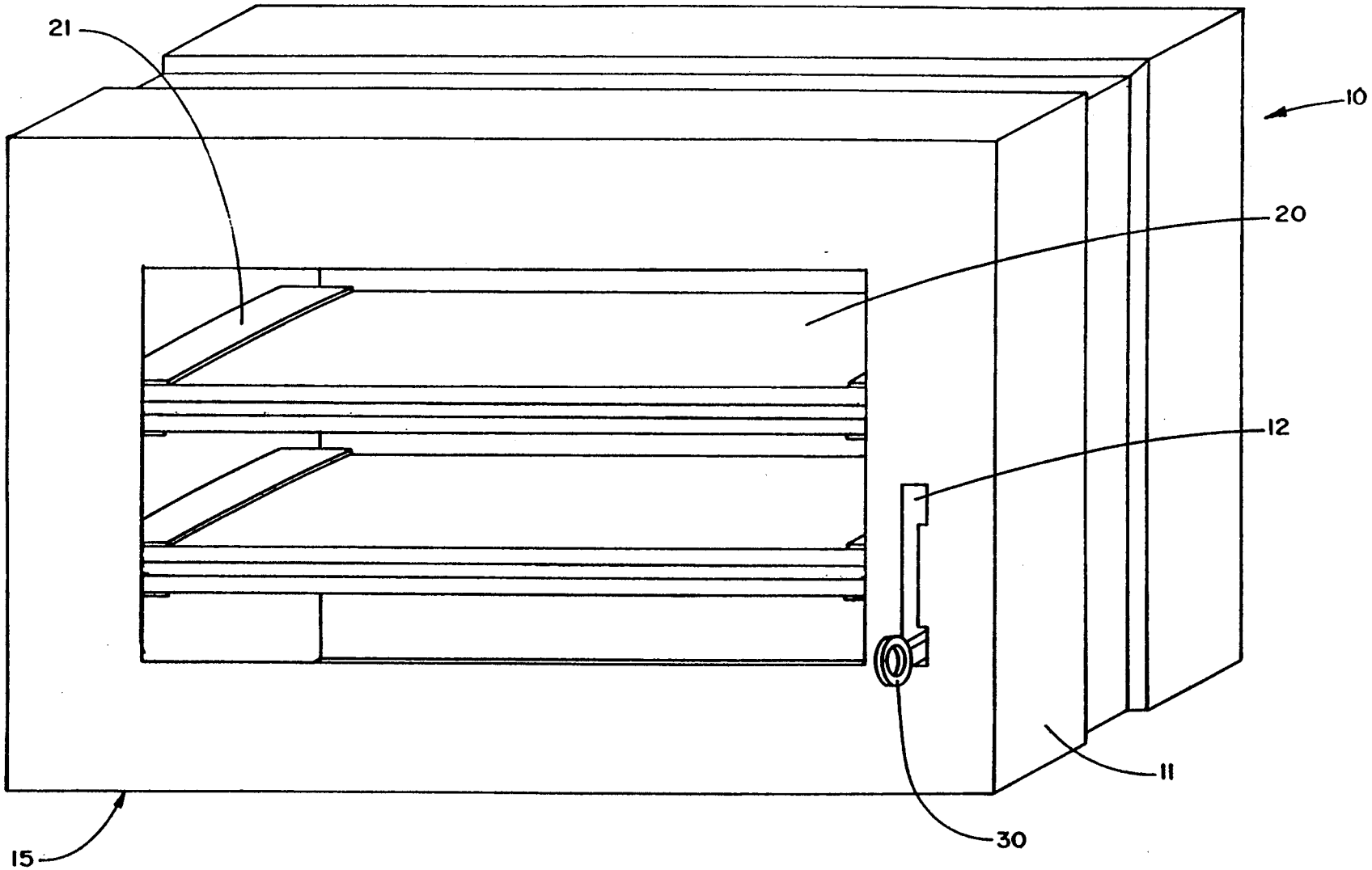
FIG. 1 is a perspective view of a window module of the present invention.

Referring in detail to the drawings and with particular reference to FIG. 1, a window 10 of the present invention is shown. This window 10 has a frame 15 formed from a number of main frame supports 11. The frame 15 has a generally rectangular shape defining an opening therein. Within this opening are a plurality of removable, pivotable sections 20. Each section 20 is held by a section holder 21 anchored to the inside of the frame as will be described later. A lever 30 is seen projecting from an aperture 12 in the front face of frame 15. This lever 30 will be used to move the pivotable sections between an opened position shown in FIG. 1 to a closed position. In the lower position of the aperture 12 as shown in FIG. 1, lever 30 will be locked in position. Similarly, when moved to the upper position of this aperture 12, lever 30 will be locked in position as will be described in more detail below.

Lever 30 is manually operated. The user can insert their finger into the loop provided on a handle section at the end of lever 30. It should be understood, however, that any suitable grasping arrangement could be used. Moreover, rather than being manually operated, any known mechanical means for moving this lever and therefore moving the sections can be used.

Figure 15:
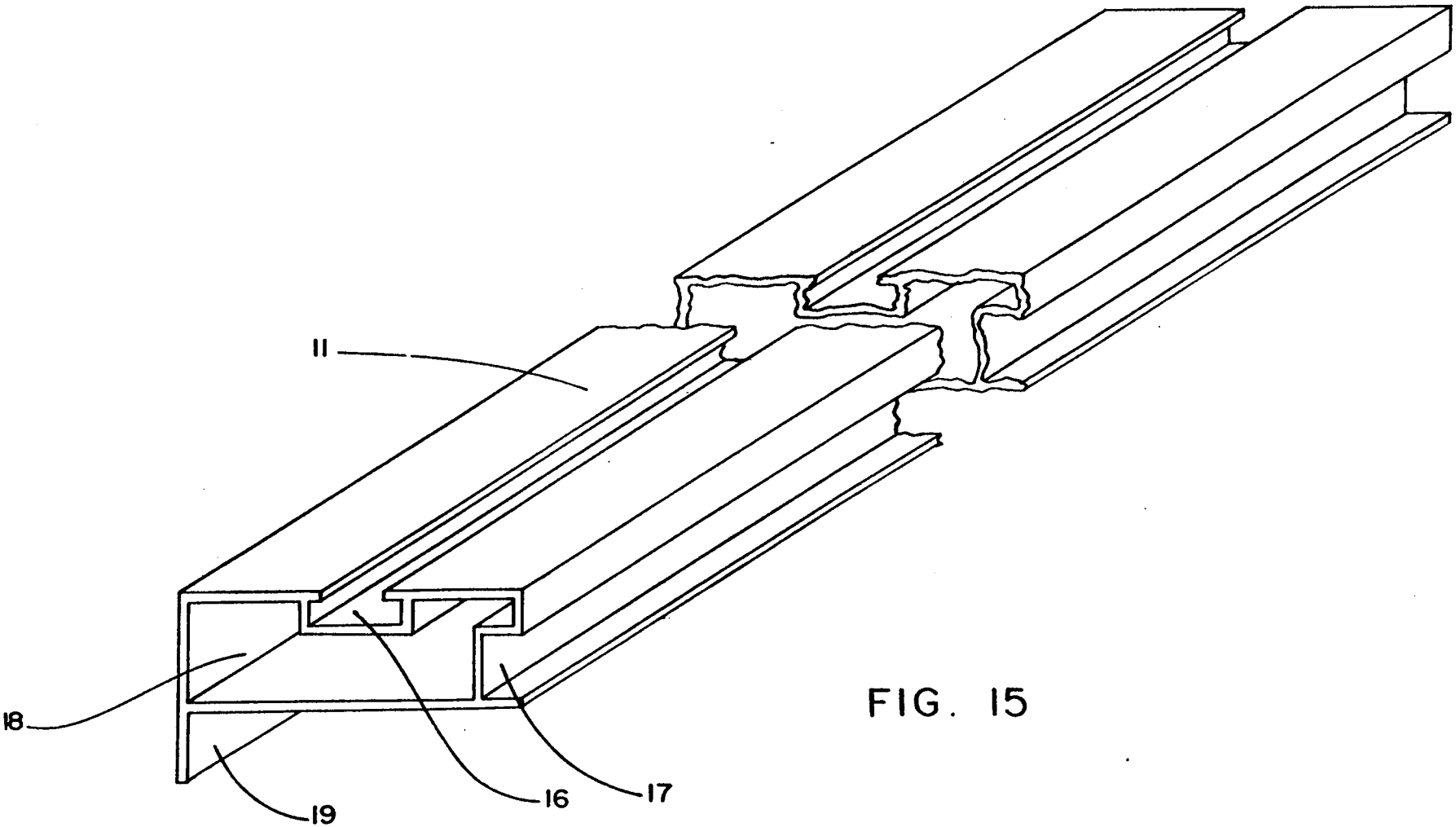
FIG. 15 is a perspective view, sectional view of the main support frame of the present invention.

The frame 15 is usually rectangular but it can be of any desired configuration. The frame 15 which is shown has four support frames 11. Turning now to FIG. 15, one of these support frames 11 will be discussed in detail It should be recognized that each support frame 11 forming the frame 15 can have the same configuration. Alternatively, it is possible that only the side support frames have the configuration shown in FIG. 15 or any other combinations of frames or single frame can have this configuration.

The support frame 11 may be made of an aluminum section or any other suitable material. On one side thereof, a rectangular groove 16 is formed. On a side adjacent this first side, a generally U-shaped groove 17 is provided. Adjacent the side having the generally U-shaped groove 17 and opposite the side having the rectangular groove 16 is a ridge 19. Overall, the support frame 11 is generally rectangular in profile. The support frame 11 may be multifunctional as will be described below.

Figure 2:
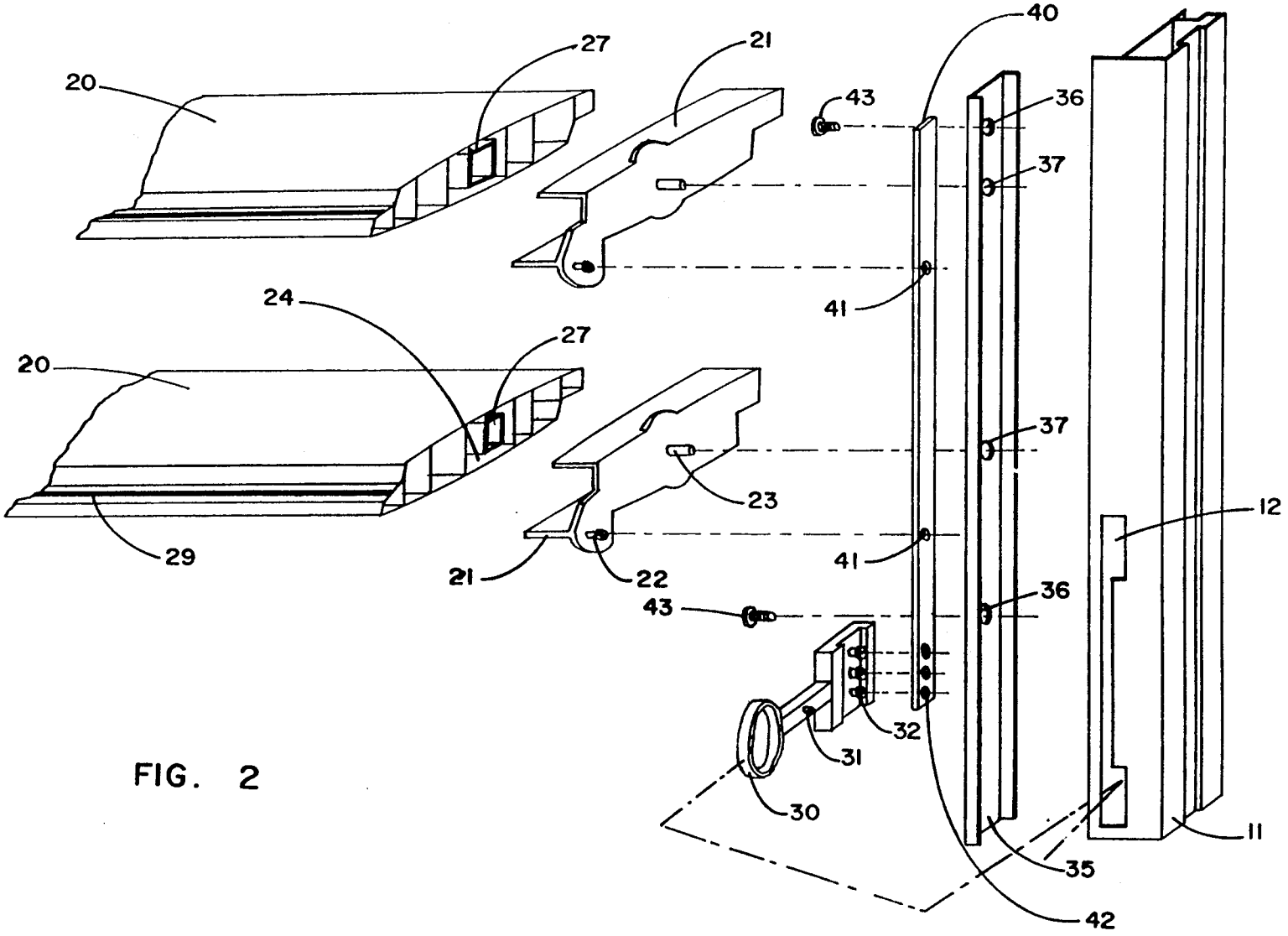
FIG. 2 is an exploded view of a portion of the window of the present invention.
Figure 16:
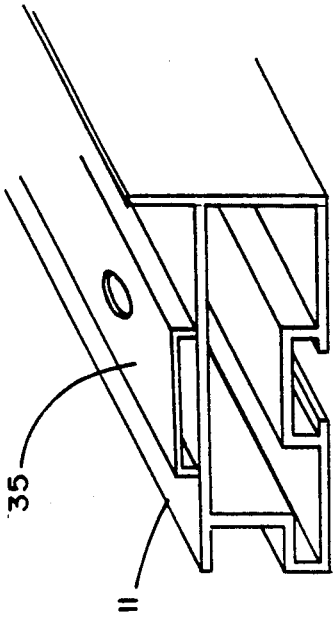
FIG. 16 is a partial view of the main support frame showing the support thereon of the present invention.

For example, as seen in FIG. 16, a support 35 (to be described in more detail later) can be attached to the support frame 11. This support 35 can be attached by screws 43 or any other suitable means as shown in FIG. 2. In this manner, it is relatively easy to assembly and disassemble the support 35 from the support frame 11 by simply removing the screws 43. The inner portion of the window 10 can therefore easily be removed from frame 15.

Figure 17A:
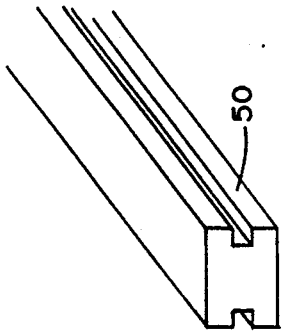
FIG. 17A is a perspective view showing a profile used to connect the two main support frames of FIG. 17.
Figure 17:
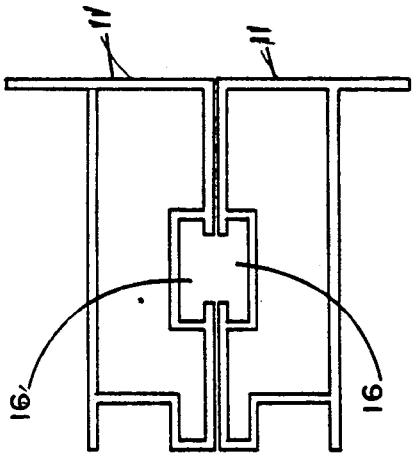
FIG. 17 is an end view showing two main interconnected support frames of the present invention.

Turning now to FIG. 17, two support frames 11 are shown mounted together. The rectangular grooves 16 are positioned adjacent one another. These two grooves 16 form a configuration into which a profile 50 as seen in FIG. 17A can be inserted. In this manner, support frames 11 can be interlinked. A user can thereby install several adjacent windows of the instant invention in series.

Figure 18A:
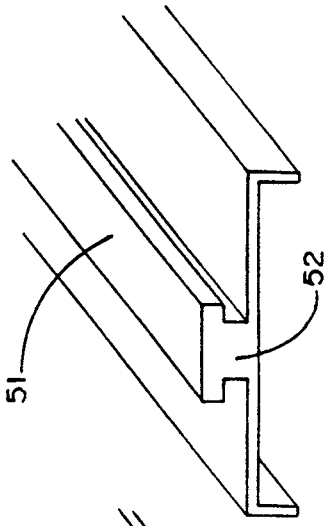
FIG. 18A is a perspective view showing the profile 51 of the present invention.
Figure 18:
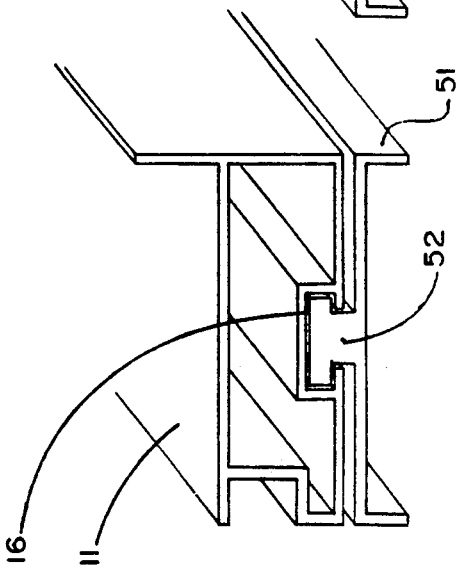
FIG. 18 is a perspective view showing the main support frame mounted on profile 51 in the present invention.

In FIG. 18, the support frame 11 is shown with a profile 51. This profile 51 is shown in detail in FIG. 18A. The profile 51 has a transfer section 52 which will fit within the rectangular groove 16. This assembly is used when the window is to be on runners and/or hinged using the profile 51. In this manner, air, dust or light can be prevented from entering the space around the window.

Figure 19:
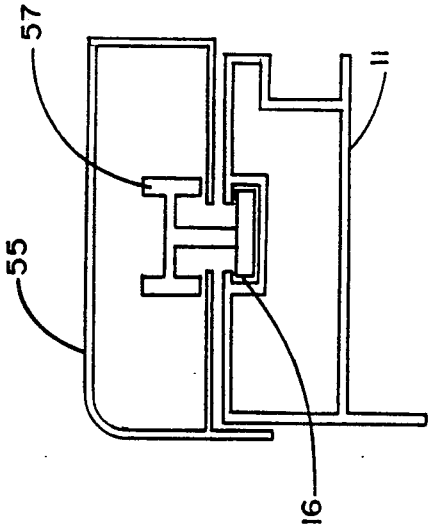
FIG. 19 is an end view of the present invention indicating the main support frame with a runner mechanism 57.

When mounting the window of the instant invention, it may be desired to open and close the window using runners. In FIG. 19, the support frame 11 for a hinged window is shown using runners with casters or bearings. A section 55 is provided with a transverse profile as seen in FIG. 19. The rectangular groove 16 can have the runner mechanism 57 inserted therein. The bearing can also run in groove 16 on the support 11.

Figure 20:
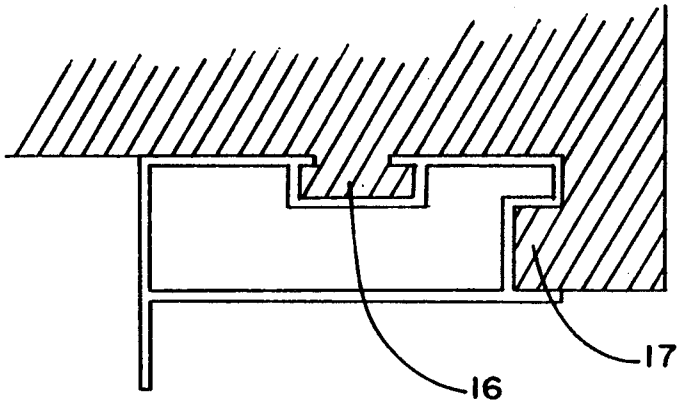
FIG. 20 is an end view showing the main support frame 20 of the present invention mounted in a wall.

An alternative arrangement is shown in FIG. 20. The frame support 11 in this configuration is mounted to a wall. Both the rectangular groove 16 and generally U-shaped groove 17 are received within the wall. In this manner, the frame 15 has great rigidity and strength.

Figure 21:
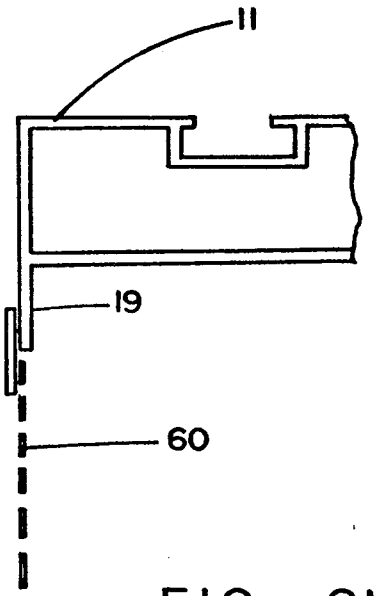
FIG. 21 is a partial end view of the main support frame showing a screen attached thereto in the present invention.

The support frame 11 of the instant invention can also be used with a screen 60 as seen in FIG. 21. This screen 60 can be mounted to the ridge 19. This screen 20 will prevent insects or the like from travelling through the window. Installation of the screen is relatively easy. For example, it can be screwed onto the ridge 19. Any other suitable means for fixing the screen 60 to ridge 19 is possible.

It can be easily seen from this disclosure that the support frame 11 has many possible uses. The window can be used in a number of situations and therefore the instant invention is highly flexible. This gives the user many design options and invites creative uses for the instant window.

Referring now to FIG. 2, the window of the instant invention will be described in detail. This FIG. 2 is an exploded diagram of the instant invention whereby the various mechanisms can more easily be seen. In this FIG. 2, a portion of the previously discussed support frame is shown. In a forward side of the support frame 11 is an aperture 12. The lever 30 will extend through this aperture 12 as previously discussed. On the forward end of the lever 30 is a handle section. This lever is seen in more detail in FIGS. 3, 5, 6 and 7.

The lever 30 further has a shaft portion and a body section. The shaft is positioned between the handle section and the body section and has a detent or peg 31 thereon. On the body section, a plurality of aligned pegs 32 with enlarged heads are provided. These pegs 32 are provided in a recess in the body section. The pegs 32 are provided only on one side of the body section as can be seen from FIGS. 5 and 7. This body section as well as a portion of the shaft will be inserted into an interior compartment of the support frame 11. A portion of the shaft and all of the handle section will extend out through the aperture 12.

As seen in FIG. 2, the interior compartment of the frame section 11 also has a movable transmission bar 40 and a support 35. While only one support 35 is shown in FIG. 2, it should be understood that the support frame opposite the support frame 11 shown in FIG. 2 would have a similar support 35. However, only one movement transmission bar 40 is normally used. If, however, the pivotable sections 20 are relatively long or some other need exists, an aperture can be provided in the frame section 11 opposite that shown in FIG. 2. A second lever 30 and movement transmission bar 40 will then be provided in this opposite frame section 11. In that matter, there will be two devices on either side of the window to open and close the movable sections.

Figure 13B:
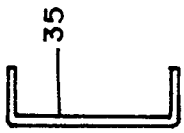
FIG. 13B is a sectional view of the support of the present invention.
Figure 13:
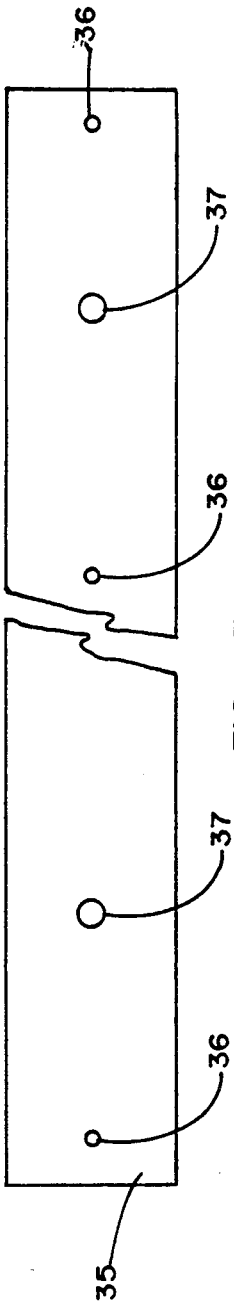
FIG. 13 is a side view of a support of the present invention.
Figure 13A:
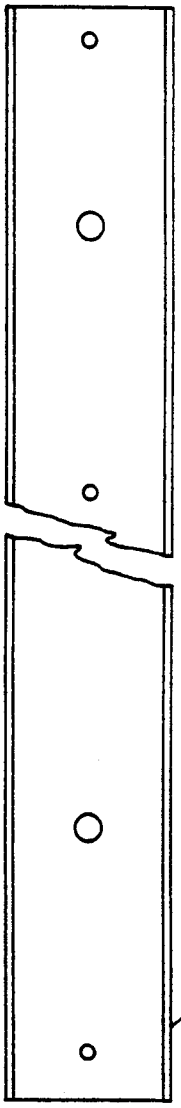
FIG. 13A is an opposite side view of the support of the present invention.

As noted with regard to FIG. 16, the support 35 can be placed against the support frame 11. This support 35 is a rectangular metal strip having a C-shape in cross-section as seen in FIGS. 13, 13A and 13B. The support 35 has a plurality of attachment holes 36 and pivot holes 37 provided thereon. Attachment holes 36 are for securing the support 35 to the frame 11 by screws 43 as shown in FIG. 2. The holes 37 are for receiving pegs or pivots 23 of the section holders 21. FIGS. 13, 13A and 13B show the main views of the support 35. The number of holes 36 depends on the length of the support 35. This in turn depends on the number and size of the sections 20 which also determines the number of holes 37.

Figure 14B:
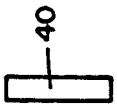
FIG. 14B is an end view of the movement transmission bar of the present invention.
Figure 14:
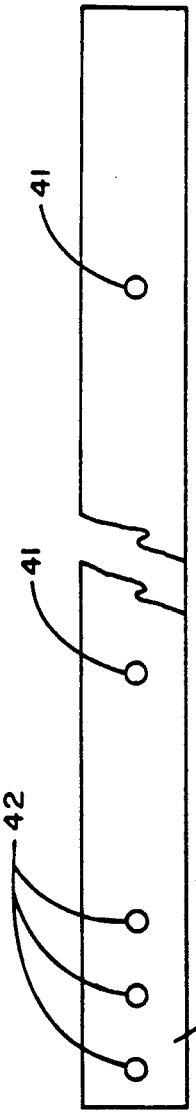
FIG. 14 is a top, sectional view of the movement transmission bar of the present invention.
Figure 14A:
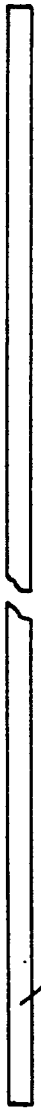
FIG. 14A is a side, sectional view of the movement transmission bar of the present invention.

As seen in FIG. 2, the movement transmission bar 40 is placed to one side of the support 35. This movement transmission bar is also shown in FIGS. 14, 14A and 14B. At one end of the movement transmission bar 40 are three mating holes 42. These holes 42 are aligned along the longitudinal axis of the movement transmission bar 40. Also aligned along this axis are receiving holes 41. These holes 41 will receive protrusions or means for engaging 22 on the various section holders 21.

The three mating holes 42 will engage the pegs 32 of handle 30. Due to the enlarged heads on these pegs 32, the handle will be generally mounted to the movement transmission bar 40.

Depending on the number of sections 20 in the window, the number of receiving holes 41 in the movement transmission bar 40 will be determined. These holes 41 are drilled along the longitudinal symmetric axis of the movement transmission bar 40. Each of the holes 41 will receive a protrusion 22. The holes 41 are positioned such that the protrusions 22 can be placed therein. The receiving holes 41 will correspond to the number of pivot holes 37.

The section holders 21 shown in FIG. 2 have these protrusions 22. It should be understood that the opposite sides of the sections 20 have section holders 21 which are a mirror image to those shown in FIG. 2. These other section holders may or may not have protrusions 22. If two movement transmission bars 40 are used in a single window, then the section holders 21 on both ends of the sections 20 will certainly have protrusions 22. However, if only one movement transmission bar 40 is used, then the protrusions 22 on the opposite side of the sections 20 can be omitted if so desired.

As shown in FIGS. 9–12, the section holders 21 have a peg or pivot 23 extending from the same side as the protrusions 22. These protrusions 22 have an enlarged head in order to maintain engagement with the movement transmission bar 40. The protrusions 22 are generally positioned at a forward or rear side of the section holder. The pegs 23 are generally located in the middle of the section holders. These pegs 23 will serve as a pivot point for rotation of the sections 20. The pegs 23 are slid into the pivot holes 37 of the support 35.

Figure 9:
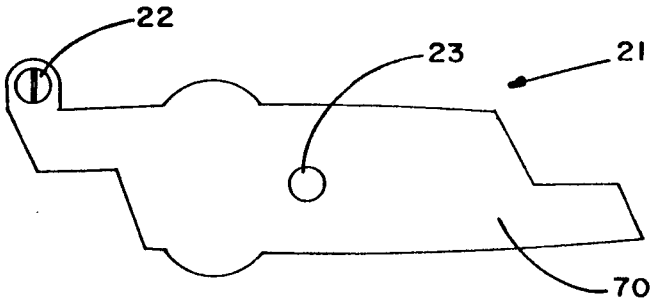
FIG. 9 is a side view of a section holder of the present invention.
Figure 10:
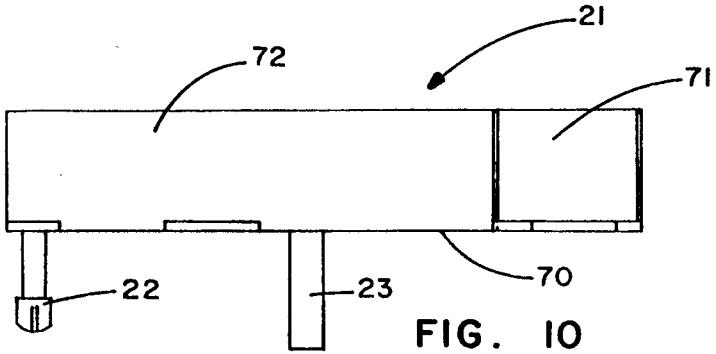
FIG. 10 is a top view of the section holder of the present invention.
Figure 11:
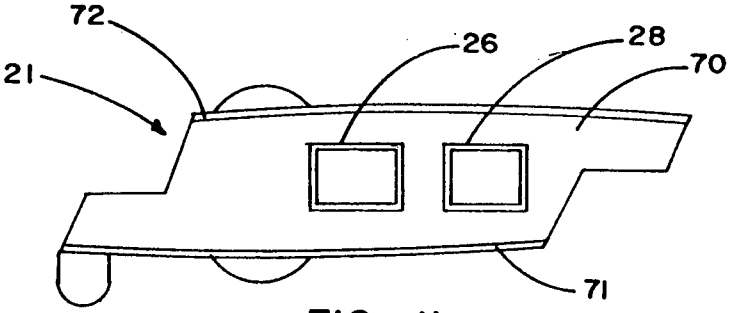
FIG. 11 is a side view opposite that of FIG. 9 of the section holder of the present invention.

The sections 20 will be readily detachable from the section holders 21. In that manner, it is relatively easy for an operator to change the sections 20, if so desired. The section holders can be made of attractively textured and colored material, such as strong plastic. They can be thought of as being generally rectangular in shape. A shorter side thereof will be cut when one corner and the other opposite sides will be cut in an opposite diagonal manner as indicated in FIG. 9. The longer sides are slightly curved as seen in FIGS. 9 and 11. Protruding from base 70 and perpendicular thereto are two receiving arms 71 and 72. These form a base or a bed to which the section 20 is fitted. From the opposite side of the base 70 and from a flap on base 70, the protrusion 22 will be mounted. This protrusion 22 is essentially cylindrical and has its end furthest from the base 70 having the enlarged head as noted above. A groove can be provided in this head running across the diameter thereof.

The protrusion 22 is designed to be inserted in the receiving hole 41 of the movement transmission bar 40 as noted above. From the same side of base 70 and towards the center of this base is the cylindrical peg or pivot 23. When the peg 23 is inserted into the pivot holes 37 of the support 35, it acts as a pivot for rotation of the section holder 21.

Figure 12:
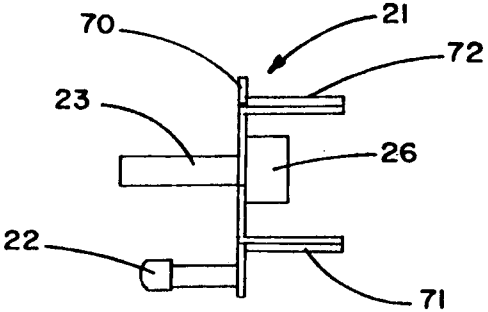
FIG. 12 is a front view of a section holder of the present invention.

FIGS. 11 and 12 show some rectangular boxes 26 and 28 which protrude from the base 70 of the section holder 21 at approximately the center thereof. These boxes can be used to engage the section 20. As seen in FIG. 2, each section 20 is generally hollow except for some longitudinal walls being provided therein. These walls provide stiffening support for each section 20. While walls are shown, it should be readily appreciated that they can be omitted if so desired. Alternatively, the sections 20 could be a solid structure.

Figure 8:
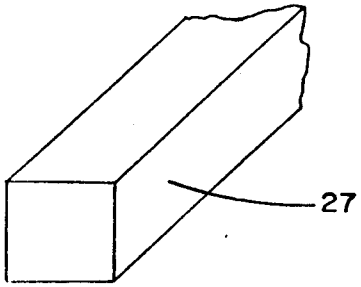
FIG. 8 is a perspective view of a portion of a reinforcing insert of the present invention.

Also shown in FIG. 2 and FIG. 8 is a reinforcing insert 27. A reinforcing insert 27 can be inserted into a central hole in each of the sections 20. Boxes 26 and 28 on the section holder will help hold either the section 20 or reinforcing insert 27 in position. These boxes 26 and 28 will fit into the rectangular holes of the section 20 and act as clamps when the reinforcing insert 27 is used. These boxes 26 and 27 will also stop the section 20 from slipping. The reinforcing insert 27 which is shown in FIG. 8 can be made of metal and can be used when the section 20 needs greater shear resistance. For example, if this section 20 is long, this reinforcing insert 27 could be used.

Figure 3:
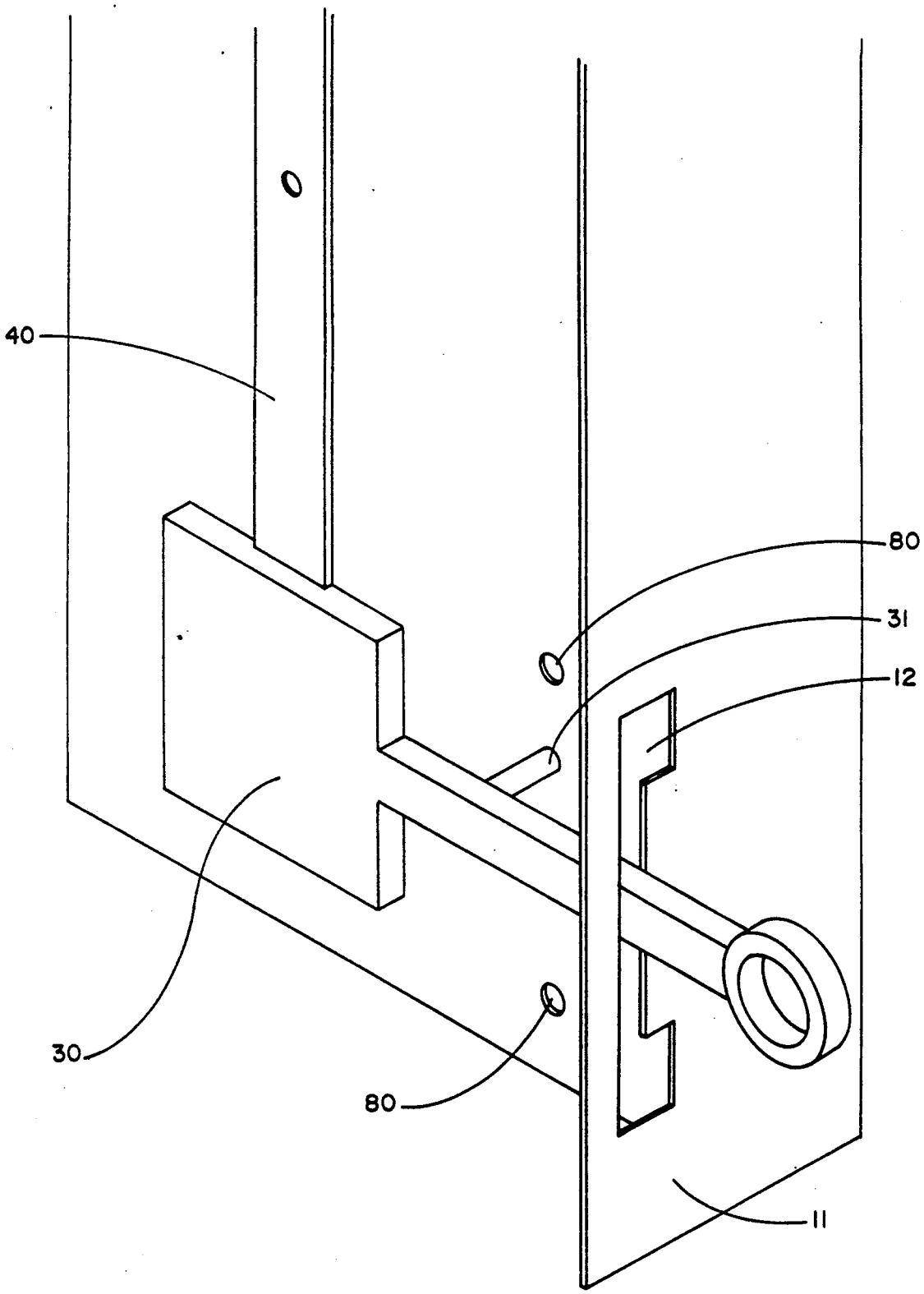
FIG. 3 is a sectional perspective view of the lever of the present invention.
Figure 5:
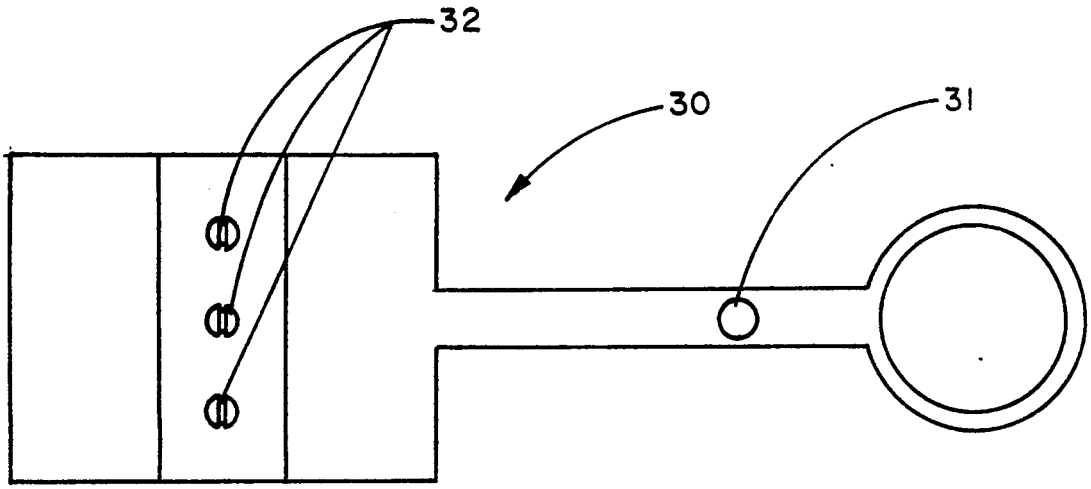
FIG. 5 is a side view of the lever of the present invention.
Figure 6:
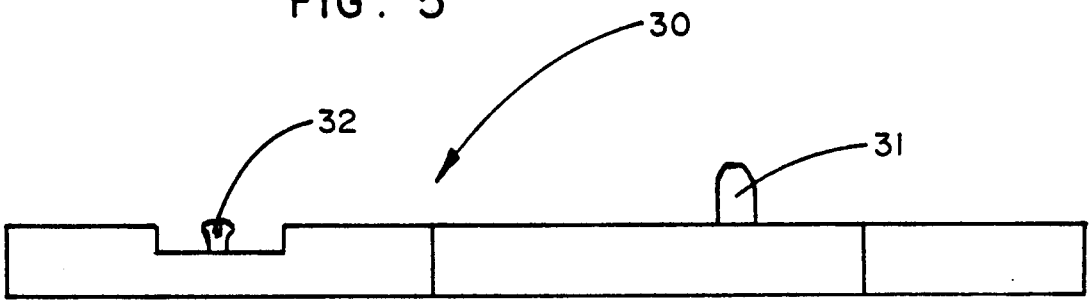
FIG. 6 is a top view of the lever of the present invention.
Figure 7:
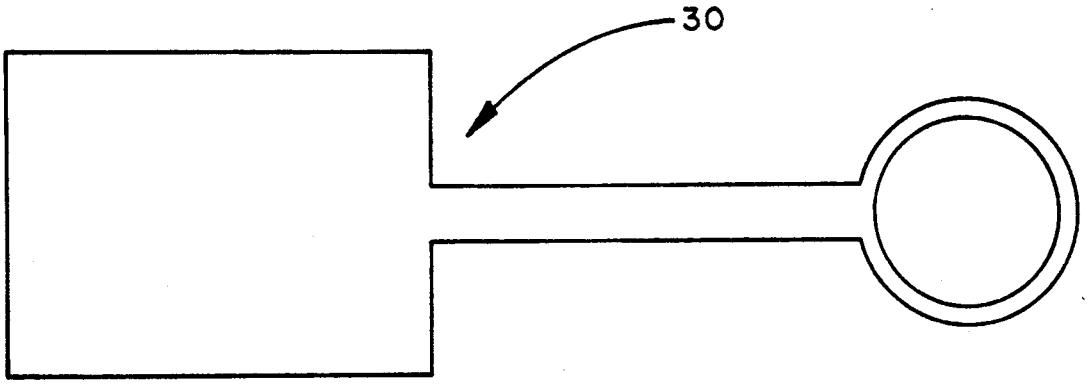
FIG. 7 is a side view opposite to that of FIG. 5 of the lever of the present invention.

Turning now to FIG. 3, operation of the lever 30 will be described. As previously noted, this lever 30 has a detent 31 on the shaft portion thereof. This detent 31 will slide along the frame section 11 between an upper and lower hole 80. These holes 80 are considered a locking means. One of the holes will be a first hole and the other will be the second hole, wherein the sections are locked in either a fully opened or fully closed position.

The lever 30 is made of a resilient material such that it can be bent. When the detent 31 is located in one of the holes 80, the longitudinal axis through the shaft of the lever will generally be straight. The shaft of the lever 30 will be resting in one of the upper or lower enlarged portions of the aperture 12 in support frame 11 when detent 31 is in one of the holes 80. To remove the detent 31 from one of the holes 30, the level can be bent and the detent is then slid along the frame support 11. When the detent 31 reaches the other hole 80, the lever will resume its previous position. Thus, the longitudinal axis along the shaft of the lever will be generally straight when the detent 31 is mounted in either of the holes 80 and will be curved in at an intermediate position therebetween.

Due to the resilient material of the lever, the lever can repeatedly be moved between the different holes 80. The lever will snap into position when the detent 31 reaches the hole 80 in order to lock the window sections in either the fully opened or fully closed position. This lever 30 is made of a flexible, high-resistant and permanently deformable plastic material, for example. While not shown in FIG. 3, a track or groove can be provided on the support frame 11 along which the detent 31 can slide between the holes 80. This detent will help to guide the movement of the lever during opening and closing of the window. However, such a groove is not mandatory.

The sections 20 of the instant invention may be made of extruded PVC with a slightly aerodynamic profile as indicated in FIGS. 2, 4, 4A and 4B. The ends of the sections 20 can be squared off such that adjacent sections will fit perfectly together to form a hermetic seal. To improve the sealing, a coextruded rubber slip 29 can be provided on each of the sections 20. FIG. 4B shows that the traverse section has a number of cavities as noted above. One of them is indexed at 24 with a desired cavity into which the insert 27 (previously discussed and shown in FIG. 8) can be inserted. This insert will be used in very long windows or in windows which are subject to adverse atmospheric conditions. The reinforcing insert 27 will also help to counter warping and other spoilage of the windows as well as prevent breakage of the sections 20 during assembly and disassembly. However, it is not necessary that this insert 27 always be used.

Assembly of sections 20 is relatively easily carried out. There are no parts for rotation which are required at these sections 20. Only the pivot 23 and the section holder 21 are needed. The support 35 is anchored as described on the support frame 11. The lever 30 and movement transmission bar 40 can be moved between an upper and lower position in the aperture 12 in order to open and close the sections 20. Thus, there are relatively few moving parts in the window of the instant invention.

Manufacturing costs of the instant invention are therefore relatively low. Also, wear of the parts is reduced such that maintenance requirements are kept low. Various designs for these instant windows are possible such that the user can be relatively creative. These windows are relatively easy to operate and if replacement of the windows is desired, this can be quickly and easily carried out. The window section 20 can be made from glass, wood, plastic or any suitable materials to the taste of the users. There is therefore great variation in the material without causing drastic changes in installation. Because the handle 30 will lock in either hole 80, some security is provided with the window in that it can be locked in a fully closed position. Rain and dampness can be kept out with the instant window. Moreover, the hermetic seal and use of the rubber strip 29 improves the energy efficiency of the instant window.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A window comprising:

a generally rectangular frame defining an opening therein;

a plurality of pivotable sections provided within said frame, each of the sections having a generally rectangular shape; and means for moving the sections between an opened position and a closed position, the opening in the frame being opened when the sections are in the opened position and being closed when the sections are in the closed position, the means for moving comprises a movement transmission bar and a lever operatively connected thereto, the frame having a face and an interior compartment, the face of the frame having an aperture defined therein and the interior compartment having two locking means therein, the movement transmission bar being located in the interior compartment of the frame and being operatively attached to each of the plurality of pivotable sections, the lever extending through the aperture in the face of the frame and having a detent located within the interior compartment of the frame, the lever being movable to slide the movement transmission bar to move the plurality of sections between the opened and closed positions, the detent on the lever being movable with the lever and engaging a first one of the two locking means when the sections are fully in the opened position to thereby lock the sections in said opened position and the detent engaging a second one of the two locking means when the sections are fully in the closed positions to thereby lock the sections in the closed position, the detent being movable between the first and second locking means.

2. The window as recited in claim 1, wherein the lever is made of a resilient material and has a longitudinal axis along a length thereof, the first and second locking means comprising respective first and second holes provided in the frame, the detent on the lever being located in one of the first and second holes to lock the sections in one of the opened and closed positions, the detent further being movable between each of the first and second holes, the longitudinal axis of the lever being generally straight when the detent is in one of the first and second holes, the lever being sufficiently pliable to bend during removal of the detent from one of the holes and during travel of the detent between the holes such that the longitudinal axis of the lever is at least slightly curved and the lever resuming a configuration with the longitudinal axis thereof being generally straight when the detent reengages one of the holes.

3. The window as recited in claim 2, wherein the end of the detent engages and slides along the frame when the sections are moved between the opened and closed positions.

4. The window as recited in claim 2, wherein the lever has a body section and a handle section and a shaft therebetween, the detent being located on the shaft and the longitudinal axis being defined through the shaft, the shaft extending through the aperture on the face of the frame and the handle being located outside the frame, the body section of the lever being mounted to the movement transmission bar inside the frame.

5. The window as recited in claim 4, wherein at least three pegs with enlarged heads are provided on the body section of the lever and three mating holes are provided in the movement transmission bar for receiving the pegs to mount the lever to the movement transmission bar.

6. The window as recited in claim 2, further comprising a support on each side of the frame, each of the supports having a plurality of pivot holes defined therein, each of the sections having a peg on a side thereof for engaging one of the pivot holes of each support, the sections further having means for engaging the movement transmission bar whereby upon deformation of the lever to remove the detent from one of the first and second holes and upon sliding of the lever to thereby slide the movement transmission bar in the frame, each of the sections are pivoted about the pegs thereon due to a connection between the means for engaging of each section and the movement transmission bar, the sections thereby being movable between the opened and closed positions.

7. The window as recited in claim 6, wherein the movement transmission bar is provided only on one side of the frame, the movement transmission bar being generally parallel to the supports, the movement transmission bar being a generally rectangular metal strip and the supports having a C-shaped cross section.

8. The window as recited in claim 6, wherein the means for engaging comprises a protrusion on one of a front and rear side of an edge of the section, the protrusion being engaged with a receiving hole provided in the movement transmission bar, the movement transmission bar having one receiving hole for each of the protrusions.

9. The window as recited in claim 8, wherein the movement transmission bar further has mating holes defined therein, the lever having a plurality of pegs for engaging the mating holes to thereby mount the lever to the movement transmission bar, the mating holes being located beneath the receiving holes and being generally longitudinally aligned therewith.

10. The window as recited in claim 8, wherein the pegs of the sections are generally located in a midsection of each side thereof and the protrusions are offset from the pegs on one side of each section.

11. The window as recite in claim 8, wherein each side of the section has a section holder, the protrusions being mounted on the section holders and the sections being slidable into and readily detachable from the section holders.

12. The window as recited in claim 11, wherein each section is generally hollow except for longitudinal walls defined therein and for a removable reinforcing insert extending therethrough, the section holders having a raised protuberance for engaging and holding the reinforcing insert.

13. The window as recited in claim 11, wherein each section has squared off ends to form an aerodynamic profile and to have a seal between adjacent sections when in the closed position, each section further having a longitudinal rubber strip to aid in sealing of the sections in the closed position.

14. The window as recited in claim 1, wherein the frame comprises four support frames, at least one of the support frames having a generally rectangular groove and a generally U-shaped groove defined therein, the support frame having four sides with the rectangular and U-shaped grooves being located on adjacent sides, the support frame further having a ridge extending from one side thereof, the side having the ridge being opposite to the side with the rectangular groove and adjacent the side with the U-shaped groove.

15. The window as recited in claim 14, further comprising a support on each side of the frame, the supports having a plurality of pivot holes and attachment holes defined therein, each of the sections having a peg on a side thereof for engaging one of the pivot holes of each support, the window further comprising screws insertable through the attachment holes and into the side of one of the support frames having the ridge thereon to thereby affix the support to the frame.

16. The window as recited in claim 15, further comprising a screen for covering the window, the screen being mountable to the ridge of the frame.

17. The window as recited in claim 14, wherein two support frames are placed side-by-side with the sides of each support frame having the rectangular grooves in abutment, the window further comprising a profile insertable in the adjacent grooves to lock the support frames together.

18. The window as recited in claim 14, further comprising runners insertable into the rectangular grooves of the support frames, whereby the frame is movable relative to the runners.

19. The window as recited in claim 14, wherein both the U-shaped groove and the rectangular groove are mounted within a wall whereby the frame is rigid and nonmovable.

20. A window comprising:

a generally rectangular frame defining an opening therein, the frame having four support frames, at least one of the support frames having a generally rectangular groove and a generally U-shaped groove defined therein, the support frame having four sides with the rectangular and U-shaped grooves being located on adjacent sides, the support frame further having a ridge extending from one side thereof, the side having the ridge being opposite to the side with the rectangular groove and adjacent the side with the U-shaped groove;

a plurality of pivotable sections provided within said frame, each of the sections having a generally rectangular shape;

means for moving the sections between an opened position and a closed position, the opening in the frame being opened when the sections are in the opened position and being closed when the sections are in the closed position; and runners insertable into the rectangular grooves of the support frames, whereby the frame is movable relative to the runners.

* * * * *